United States Patent [19]

Offen et al.

[11] 4,369,215

[45] Jan. 18, 1983

[54] FINGER HELD POMPON

[75] Inventors: Matt D. Offen; Frederick M. Sanders, both of Fresno, Calif.

[73] Assignee: Nevada Post Office Corporation, Los Gatos, Calif.

[21] Appl. No.: 328,230

[22] Filed: Dec. 7, 1981

[51] Int. Cl.[3] ..... D04D 7/06

[52] U.S. Cl. ..... 428/4; 28/147; 46/1 R; 46/126; 428/35

[58] Field of Search ..... 428/4, 36, 35; 46/1 R, 46/116, 123, 126; 28/147

[56] References Cited

U.S. PATENT DOCUMENTS

| | | | |
|---|---|---|---|
| 2,646,796 | 7/1953 | Scholl | 428/36 X |
| 2,725,670 | 12/1955 | Hodes | 46/123 X |
| 2,787,862 | 4/1957 | Hoeflich | 46/1 R |
| 2,810,977 | 10/1957 | Barry | 46/1 R |
| 3,560,313 | 2/1971 | Herkimer | 428/4 |
| 4,201,806 | 5/1980 | Cole | 428/4 |

OTHER PUBLICATIONS

Try It Five Funny Finger Folks, Washington Post, 7-20-49.

*Primary Examiner*—Thomas J. Herbert, Jr.
*Attorney, Agent, or Firm*—Sherman Levy

[57] ABSTRACT

A pompon is provided that includes a plastic body member that has strands attached to an end thereof, and wherein a clip is provided for holding the strands in place on the member. One end of the holder or member is open so that a coupon or the like can be conveniently inserted within the member. Suitable advertisements, logos, and the like can be imprinted on the outer surface of the finger held pompom. The finger held pompon includes a receptacle that is constructed of plastic material of resilient characteristics whereby the user's finger can be conveniently inserted within the device to provide a convenient means of manipulating the pompon.

1 Claim, 5 Drawing Figures

FINGER HELD POMPON

BACKGROUND OF THE INVENTION

The present invention relates to new and improved devices of the nature of finger held pompons, and more particularly the invention is directed to a method and apparatus of manufacture and constructing a finger held pompon. The finger held pompon is constructed of a flattened tubular body having two folded edges of the tubular body, an open end, a set of shoulders at the other end which extend further into a neck or stem on which there is a terminating nodule. On the neck there is affixed and securably maintained a tassel structure or pompon that is secured by a fastener member, staple, C-shaped clamp, clip member, or the like. Such a fastener member is adapted to be fastened by automatic machinery or the like so that the hand held pompons can be manufactured at high speed and at relatively low cost, and with maximum efficiency. By opening the flattened tubular body by squeezing or mashing the distal edges about the opening together, the opening is enlarged for receiving at least one finger. Upon insertion of the finger, the opening is then closed by release of distal edges about the opening, and then the pompon is ready to be waved, swung, and circled about one's body and in the usual manner that pompons are displayed in motion.

FIELD OF THE INVENTION

The invention relates to an improved and easily constructed, economical to manufacture finger held pompon structure and the devices of the present invention are manufactured for advertising novelties, premiums, disposal items for use during parades, conventions, all sporting events, and the like, by rooters, cheerleaders, and other enthusiasts; while afterword, they may be discarded, or disposed of like any other disposable item.

PRIOR ART DISCLOSURES

There are no known prior art disclosures, whether taken singly or in combination with each other that have a bearing on the patentability of any claim of the invention. Of interest however, are the following U.S. patents:

U.S. Pat. No. 1,612,495
U.S. Pat. No. 2,155,753
U.S. Pat. No. 2,348,962
U.S. Pat. No. 3,228,033
U.S. Pat. No. 3,560,313
U.S. Pat. No. 3,637,452
U.S. Pat. No. 4,044,438
U.S. Pat. No. 4,084,824
U.S. Pat. No. 4,127,222
U.S. Pat. No. 4,287,647

SUMMARY OF THE INVENTION

An object and advantage of the present invention is to provide a uniquely constructed and novel arrangement of a finger held pompon. The finger held pompon is constructed of a flattened tubular body which is squeezed open for applying at least one finger for frictional engagement and retention therein, and when a pompon structure is fastened on to a free end of the finger held pompon structure, the pompon may be waved, swung, and used to dance about and displaying and exhibiting the new and unique finger held pompon.

Another object and advantage of the present invention is to provide a simply constructed, disposable arrangement of parts that can be used in advertising, promotion, and educational areas for the benefit of all sporting events, carnivals, parades, conventions, parades and the like.

An additional and further object of the present invention is to provide a device that is easy to manufacture and to construct, as well as easy to assemble for use. Within the purview of the invention, the object is to further provide a finger held pompon structure having an extension or stem for receiving in attached relation a pompon structure that does not give out or disintegrate on continued use. The apparatus of the present invention is easy to maintain and is reusable from time to time, whether the same pompon structure is used or whether further and additional pompon arrangements are fastened or clipped on to the stem of the finger held pompon device.

An object of the present invention is to provide a hand held pompon that is ruggedly constructed and efficient to use, and which is relatively simple and inexpensive to manufacture and merchandise.

A still further object of the present invention is to provide a finger shaker or thumbshaker pompon which is adapted to be conveniently molded of a suitable plastic material. Heretofore, pompons have been made wherein the strands of material have been tied in place, but with the present invention a highly unique method of clamping, or fastening the strands to the holder is provided. With the present invention when manufacturing the pompons, the sheet of plastic from a roll of material is adapted to be utilized, and wherein the plastic crosses over a slitter, so that the plurality of slits are formed in the plastic, and at the same time a folding operation is performed, and then the strands go on to a wheel member, and the wheel can be subsequently stopped so that the operator can attach staples, clamps or the like for holding the strands in place.

A still further object of the present invention is to provide a hand held pompon which is adapted to have advertisements, logos, or the like screened printed or otherwise arranged on the outside of the unit so that the unit can be used as a highly effective, relatively inexpensive advertising device, and wherein premiums, coupons, and the like can be provided with the device, and for example such premiums, coupons, and the like can be conveniently inserted in the hollow interior of the member to be subsequently removed when desired or required. The plastic holder is adapted to be made in any suitable manner, as for example by using dip molding, and wherein when utilizing dip molding, the plastic can be inserted or removed and subsequently cooled in the desired manner. The holder is adapted to be made of soft plastic and pliable material. The pompons can be made so that they are highly colorful and can be used for any desired purpose, as for example they can be used by drill teams, pompon squads, and wherein the strands will not come loose from the handle or holder. The units are light in weight and can be made of waterproof plastic in any desired color combinations. The shakers can have a glossy appearance so that the same will catch and reflect light. The device is constructed so that it assures ease in handling and extra comfort when performing. The unique construction of the neck portion of the holder together with the clamp assures that the strands will not come loose, and wherein with the present invention various pompon routines can be performed in a gym or on a field, and in addition, the present invention is especially suitable for the thousands of spectators as well as for cheerleaders.

These and other objects of the invention will be apparent to others skilled in the art to which this invention pertains, considering the following detailed description and the drawings.

DESCRIPTION OF THE PREFERRED EMBODIMENT

Figure 1:
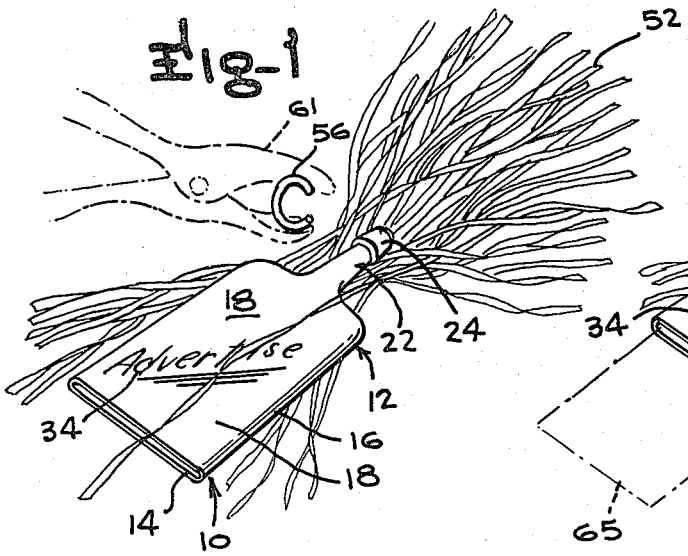
FIG. 1 is a perspective view illustrating a pompon being prepared for attachment thereon by the method of assembly and construction according to an embodiment of the present invention.

Referring in detail to the drawings, the finger held pompon comprises a finger receiving receptacle 10 having a generally flattened tubular body 12 with an open end 14, side edges 16 that may be slightly tapered, spaced apart front and rear flattened surfaces 18, a closed or closure shoulder 20 for each side of the tubular body, and a neck or stem 22 extending distally of the tubular body but terminating in a closure cap or nodule 24. The interior of the nodule, forms a hollow space 30 shown in FIG. 5. The body, neck and nodule are of a unified manufacture and construction of molded plastic material, the material having a characteristic of resiliency and memory, such that when it is deformed or disoriented, mashed or contorted, such as by one's hand or hands, then on release it will return to its original shape and contour as shown in FIGS. 1, 2, 4, and 5.

On either or both of the flat surfaces 18, advertising, printed matter, logos, on instructional and educational indicia 34 may be inscribed, imprinted, etched or painted thereon.

Figure 2:
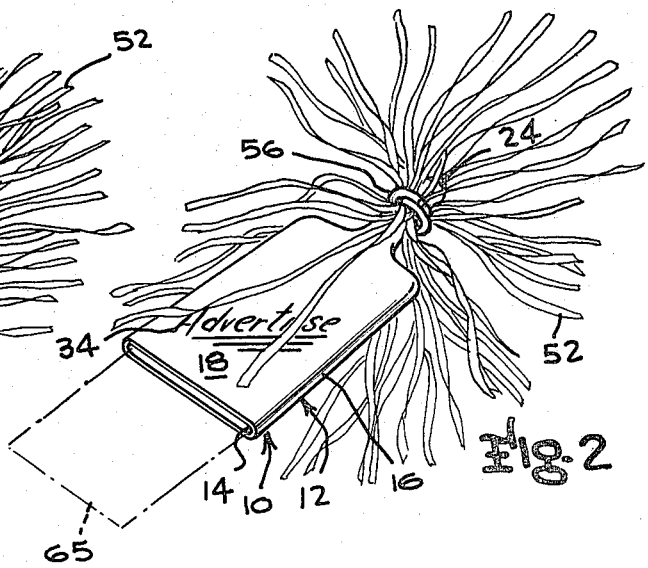
FIG. 2 is a perspective view showing the strands of the pompon attached and held in place by the clamp or retainer.
Figure 3:
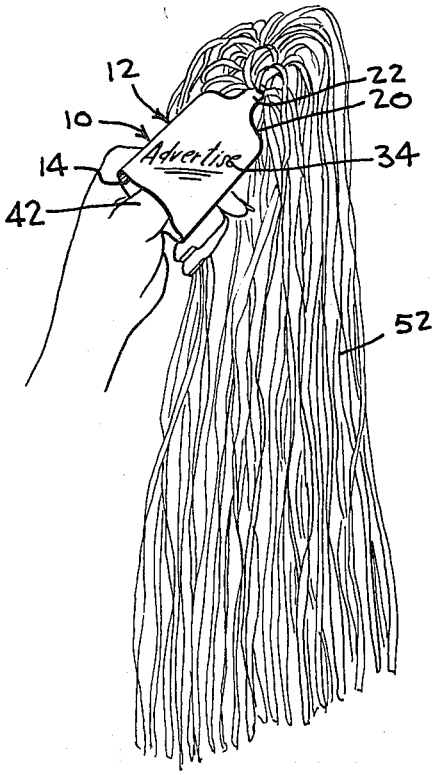
FIG. 3 is a perspective view, in smaller scale, showing how the flattened tubular finger member retains itself on to one's finger.
Figure 5:
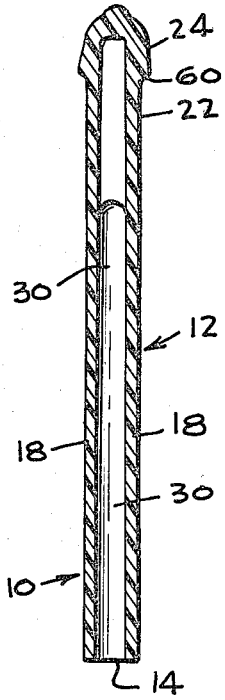
FIG. 5 is a sectional view taken on the line 5—5 of FIG. 4.

The body 12 can be grasped in one's hand and the side edges 16 proximate the open end 14 which can be mashed or squeezed so that the mouth or open end 14 is caused to yield and open, thus opening the receptacle body 12 and one's finger 42, shown in FIG. 3, or fingers, more than one if desired or possible by the size of the open end, is inserted or placed into the open tubular body 12. On release of the sides of edges 16 and due to the memory and resiliency of the plastic material, the open end 14 returns to its closed position and elongated appearance as shown in FIGS. 1, 2, and 5. Thus, the tubular body 12 is returned to its flattened configuration and the finger, or thumb, as the case maybe as shown in FIG. 3, is caught and retained within the body 12.

The parts can be made of any suitable material and in different shapes or sizes as desired or required.

Figure 4:
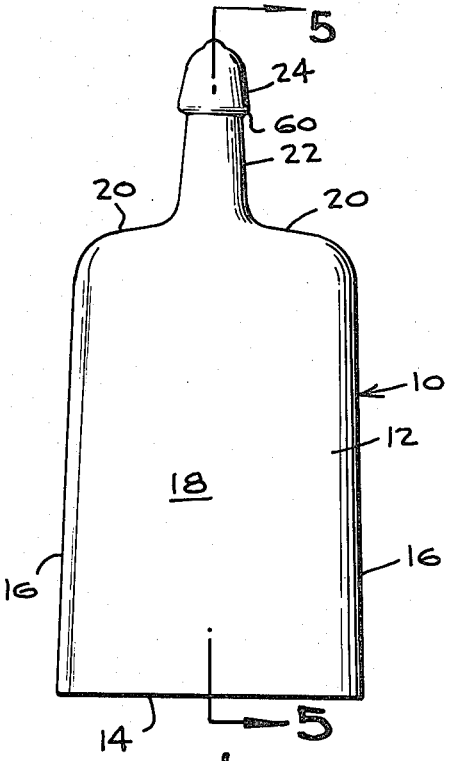
FIG. 4 is an elevational view of the device without the strands attached thereto.

As shown in the drawings, portions of the strands 52 of the pompon can be positioned adjacent the stem 22 of the body 12, and a clamp C-shaped clip 56 or the like as shown in FIG. 1 can be applied to the device so that the clip 56 can be placed around the stem 22 of the body, and the clip 56 can be squeezed on to the stem 22 so that the pompon will then be held securely in place as shown in FIGS. 2 and 3. There is provided a shoulder 60 on the stem 22 as shown in FIG. 4 so that the clip 56 will co-act with the shoulder 60 to retain or maintain the parts in their proper assembled position. FIG. 1 illustrates diagramatically a pair of pliers that are used for mounting the clip 56 in place, but it is to be understood that this is only schematic or diagramatic so that in actual practice, such clips 56 will be attached by automatic machinery in a high-speed operation. The shape of the nodule 24 in conjunction with the shoulder 60 and stem 22 is such that the parts will not move out of their proper position. Because of the hollow interior of the stem 22, the stem 22 will have a certain degree of resiliency so that the clamp 56 will be able to exert a holding action on the strands, in the desired manner.

It will be noted that the pompon is adapted to be used on the hand or fingers by the above relationship of the several parts between the pompon 52 and the finger or thumb 42, and for example, by swinging or waving of the hand, the pompon is also brought into action in following the hand. Release of the finger from the flattened tubular body 12 is achieved in a reversed mode of operation from that described above for opening and inserting of the finger into the form.

From the foregoing, it will be seen that there has been provided a finger held pompon, and in use with the parts arranged as shown in the drawings, the pompon strands 52 are adapted to be provided from a suitable source of supply, and the strands are suitably clamped on to the end of the member or body 12 by means of a retainer such as the clamp 56. The member 12 includes the neck portion 12 that has the shoulder 60 thereon adjacent the enlargement or nodule 24 so that a firm clamping action is provided adjacent to or contiguous to the shoulder 60 by means of the retainer 56, whereby the device is provided in the manner illustrated. As shown in FIG. 2 in broken lines, a premium, coupon or the like 65 can be conveniently utilized with the device, and such a premium, coupon or the like 65 can be conveniently inserted into the open end 14 of the device and into the hollow interior 30. Then, when the coupon or premium 65 is to be used, the same can be readily manually removed from the space 30. Suitable advertisements, indicia, and the like 34 can be conveniently silk screened or imprinted on either or both of the surfaces 18 so that the hand held pompon of the present invention provides an inexpensive, highly novel advertising device which can be used to advertise slogans, trademarks, or to create goodwill and the like.

When using the device, one or more of the fingers such as the finger 42 can be inserted into the open end 14 and into the space 30, and due to the inherent resiliency of the body 10, the member will be firmly clamped on to one or two of the user's fingers. Then, with the device on the fingers, the hand can be moved to create a highly attractive effect in the same manner that other types of pompons are utilized.

While several embodiments of the present invention have been illustrated herein in particular detail, it will be understood that variations and modifications may be effected without departing from the spirit and scope of the novel concepts of this invention.

What is claimed:

1. As a new article of manufacture, a hand-held pompon comprising a body member of pliable plastic memory material having one end open and its interior hollow, said hollow body member adapted to have a user's finger inserted therein and advertising indicia placed on the outer surface thereof, said body member defining a normally flattened receptacle having side edges and spaced apart front and rear flattened surfaces, and a hollow stem extending distally from the end of the body member opposite the open end thereof, said stem terminating in an outer enlarged nodule having an annular shoulder at the inner portion thereof; a plurality of pompon strands adjacent said stem; and a clamping retainer securing a portion of said strands to said stem, and said retainer abutting said shoulder.

* * * * *